United States Patent [19]

Partyka

[11] Patent Number: 4,544,314

[45] Date of Patent: Oct. 1, 1985

[54] CAN END DIVIDER

[75] Inventor: Edward S. Partyka, Richmond, Va.

[73] Assignee: Reynolds Metals Company, Richmond, Va.

[21] Appl. No.: 671,518

[22] Filed: Nov. 15, 1984

[51] Int. Cl.[4] ..... B21D 51/00

[52] U.S. Cl. ..... 413/26; 221/217; 413/8; 413/50

[58] Field of Search ..... 413/8, 9, 11, 12, 26, 413/50, 52; 221/211, 217

[56] References Cited

U.S. PATENT DOCUMENTS

| | | | |
|---|---|---|---|
| 1,161,931 | 11/1915 | Dixon . | |
| 1,943,444 | 1/1934 | Knowlton | 198/35 |
| 2,081,809 | 5/1937 | Gladfelter | 221/217 |
| 2,382,405 | 8/1945 | Eckman | 294/64 |
| 2,433,736 | 12/1947 | Carew | 312/44 |
| 2,656,911 | 10/1953 | Boyce et al. | 198/31 |
| 2,659,522 | 11/1953 | Ninneman et al. | 226/88.1 |
| 2,769,419 | 11/1956 | Ertcken | 413/50 |
| 3,800,400 | 4/1974 | Mistorz | 221/211 |

*Primary Examiner*—Leon Gilden

*Attorney, Agent, or Firm*—Alan T. McDonald

[57] ABSTRACT

An apparatus is disclosed for dividing a single stick of can ends into a pair of can end sticks. The apparatus includes a pair of driven groved roll wheels between which the can ends are separated and fed in a pair of intermeshed star wheels for receiving the can ends and separating them into two separate can end sources.

9 Claims, 6 Drawing Figures

CAN END DIVIDER

BACKGROUND OF THE INVENTION

The production of can ends, and notably can ends having easy-opening features thereon, for use on beverage containers for, for example, soft drinks and beer, is a multi-stage operation. Metal sheet, typically formed from an aluminum or steel alloy, is fed to a blanking press, where circular blanks are cut from the sheet and shaped between a pair of dies into flush panel ends.

These flush panel ends are then passed to a curler, which forms a flange around the outer edge thereof to enable the end to be sealed to a can body by the commonly-accepted double seaming operation.

Finally, the flush panel ends are fed to a conversion press. In this press, the ends pass between a series of pairs of forming dies, which dies produce the easy-opening feature. Included in this conversion operation are scoring, rivet forming and tab staking. The finished ends exiting from the conversion press are then ready for packaging and sale.

Initially, either the relatively low speeds of the equipment involved were fairly well matched or economics permitted manual handling of the ends between stations.

More recently, however, increased labor costs and improvements in can end manufacturing equipment have dictated a need for a fully mechanized can end forming system with reduced manning levels and virtual elimination of manual handling of the ends from their initial stamping to their completion.

A major problem in accomplishing full mechanization in a can end line is in the speed differentials or, more accurately, the throughput differentials, between portions of the system. Advances in blanking press speed have increased the number of ends which can be produced per die lane in a given amount of time. Additionally, advances in blanking press size have allowed multiple lane dies to become a commercial reality. It is thus not uncommon for a single large end forming press to out perform two or even three older model presses.

Concurrently, advances in curling equipment, including the use of double lane curlers, have enabled this portion of the system to keep up with the end blanking presses.

The bottleneck, however, resides in the conversion press. Requiring multiple stations, in-feed and placement of tabs onto the ends, and intricate die tooling, these presses operate at speeds far less than those of end blanking presses. While multiple lane end conversion presses are known, the need for either multiple conversion presses or a multiple lane conversion press requires that the ends be divided into separate lanes somewhere between the curler and the conversion press.

Typically, this has been a manual operation. An operator stationed between the curler and the conversion press manually removes a stick containing, for example, 400 or so ends at a time from the exit lane of the curler and alternately feeds these ends into the entrance lanes of either separate conversion presses or separate lanes of a multi-lane conversion press, bagging excess ends created in the blanking portion of the system above the number of ends that can be handled in a given amount of time by the conversion portion of the system. To completely automate the system, there is a need, therefore, for an apparatus capable of reliably dividing a supply of can ends from a single stick or lane into a pair of can end lanes. The apparatus must also be capable of adjusting or otherwise accounting for speed variations between the somewhat faster blanking portion of the system and the somewhat slower conversion portion of the system, so that any excess flush panel ends can be diverted to a temporary storage area.

BACKGROUND OF THE INVENTION

By means of the present invention, this desired objective has been obtained.

The apparatus of the present invention comprises a can end diverter having a pair of groved wheels or screws for feeding and spacing can ends received from a lane of ends, a pair of intermeshed star wheels, the star wheels being arranged to alternately receive can ends from the wheel or screw mechanism and remove the ends from their point of reception, a pair of discharge positions for each star wheel, each discharge position including a primary discharge lane through which the bulk of the ends will pass and a secondary discharge lane for receiving surplus ends above those which can be readily handled by the subsequent can end conversion equipment and means for selectively guiding the ends from the star wheels to the primary or secondary exit lanes.

Employment of the can end diverter of the present invention allows automated handling of the end from its initial formation as a flush panel end through its conversion to an easy-opening end, provides a buffer for accumulation of excess ends due to throughput variations between the can end blanking and can end converting portions of the system or the shut down of a portion of the can end conversion system, thus enabling excess ends to be manually stored for feeding to the conversion portion of the system during downtime of the blanking portion of the system, creating increased productivity for the complete end line.

BRIEF DESCRIPTION OF THE DRAWINGS

The can end diverter of the present invention will be more fully described with reference to the drawings in which.

DETAILED DESCRIPTION OF THE PREFERRED EMBODIMENT

Figure 1:
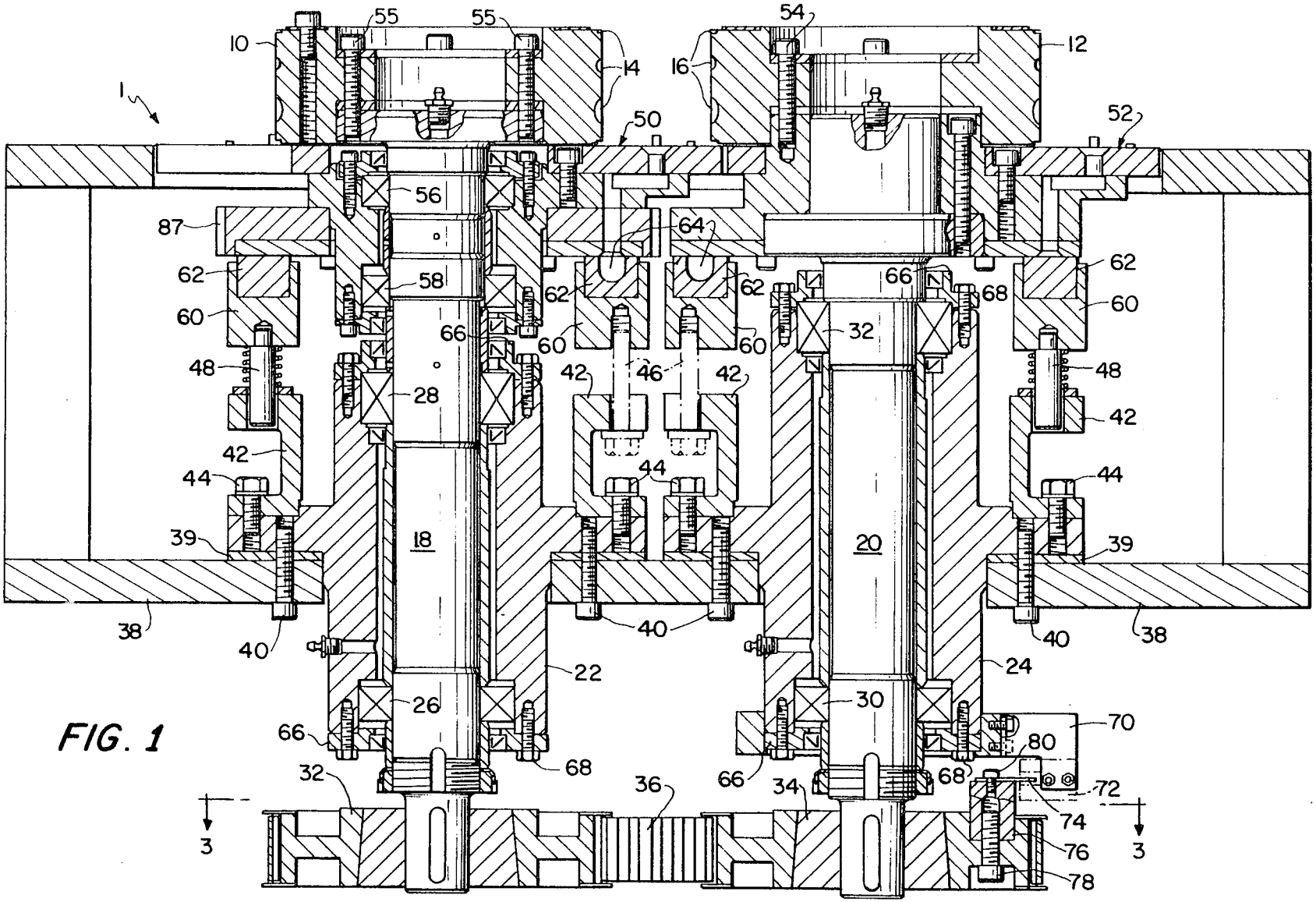
FIG. 1 is a cross-sectional view of the main portion of the can end diverter.
Figure 3:
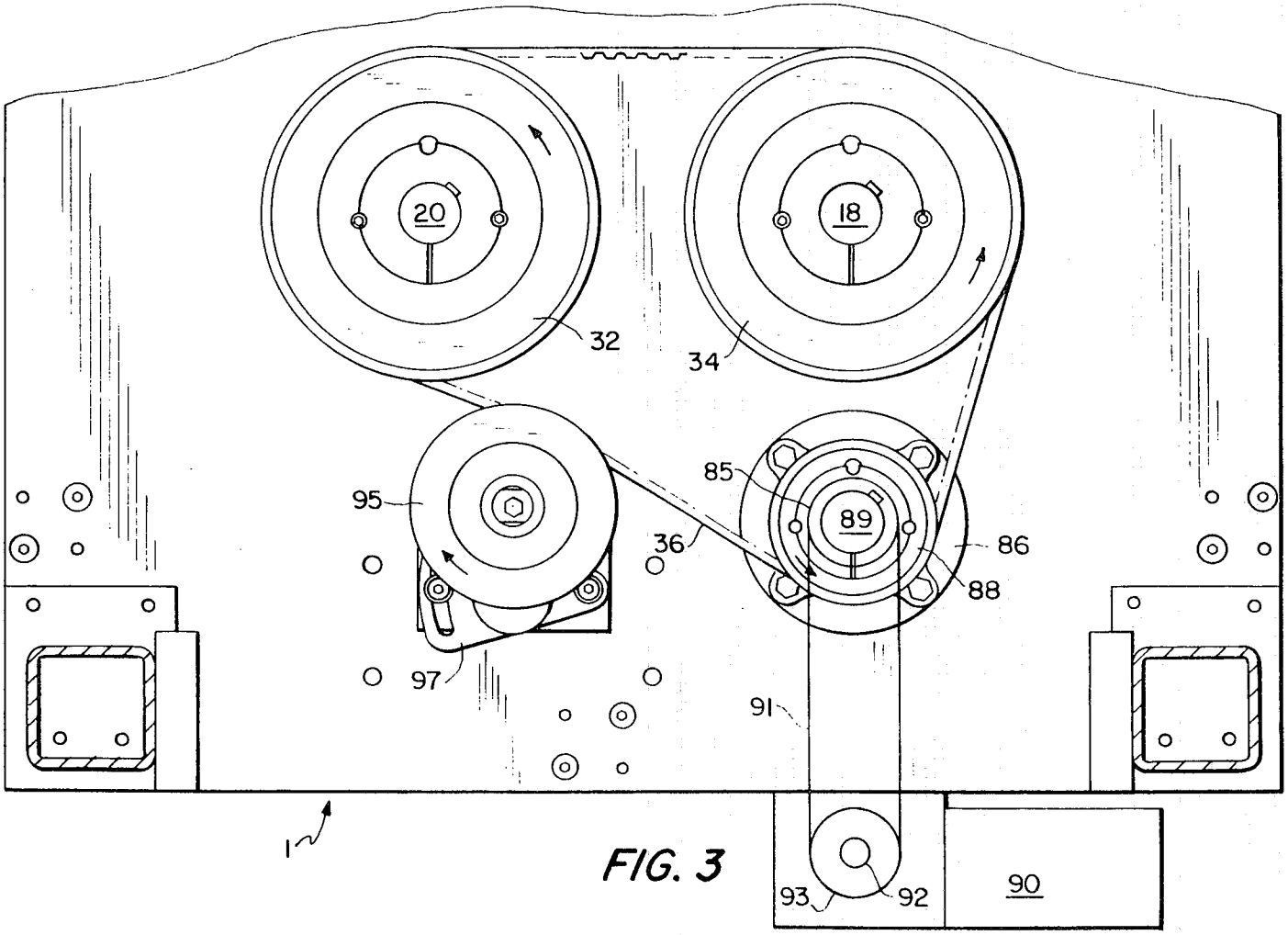
FIG. 3 is a cross-sectional view along line 3—3 of FIG. 1, illustrating the driving mechanism for the can end diverter.

Turning now to the FIGURES, the main body of the can end diverter 1 is illustrated in cross-section in FIG. 1. A pair of feed wheels or screws 10 and 12, having matching spiral grooves 14 and 16 respectively in their outer surfaces, are mounted for rotation on shafts 18 and 20 respectively, which shafts 18 and 20 are in turn mounted on pulleys 32 and 34 respectively. Pulleys 32, 34 and 88 are surrounded by a toothed timing belt 36, or other similar timing mechanism, such as a chain, and, as can best be seen in FIG. 3, are driven for rotation in the same direction by a motor means 90. Feed screws 10 and 12 are positioned beneath a stack of can ends (not shown), which can ends are preferably in their inverted position, to prevent damage to their bottom coatings, for reasons that will be shown below. With the mounting of feed screws 10 and 12 for rotation in the same direction, and with the alignment of grooves 14 and 16 resulting, feed screws 10 and 12 provide for controlled entry and spacing of can ends to the can end diverter 1. The grooves 14 and 16 are aligned and the speed of the screws 10 and 12 is controlled such that a generally continuous, downward path is provided for each can end, without significant rotation of the end, by gravity, rather than a forced feeding.

Shaft 18 is mounted within housing 22 and shaft 20 is mounted within housing 24, which housings 22 and 24 are mounted by means of screws 40 to base 38. Shaft 18 includes bearings 26 and 28, held in place by end plates 66 and screws 68 and shaft 20 includes bearings 30 and 32, which are also held in place by end plates 66 and screws 68.

Figure 2:
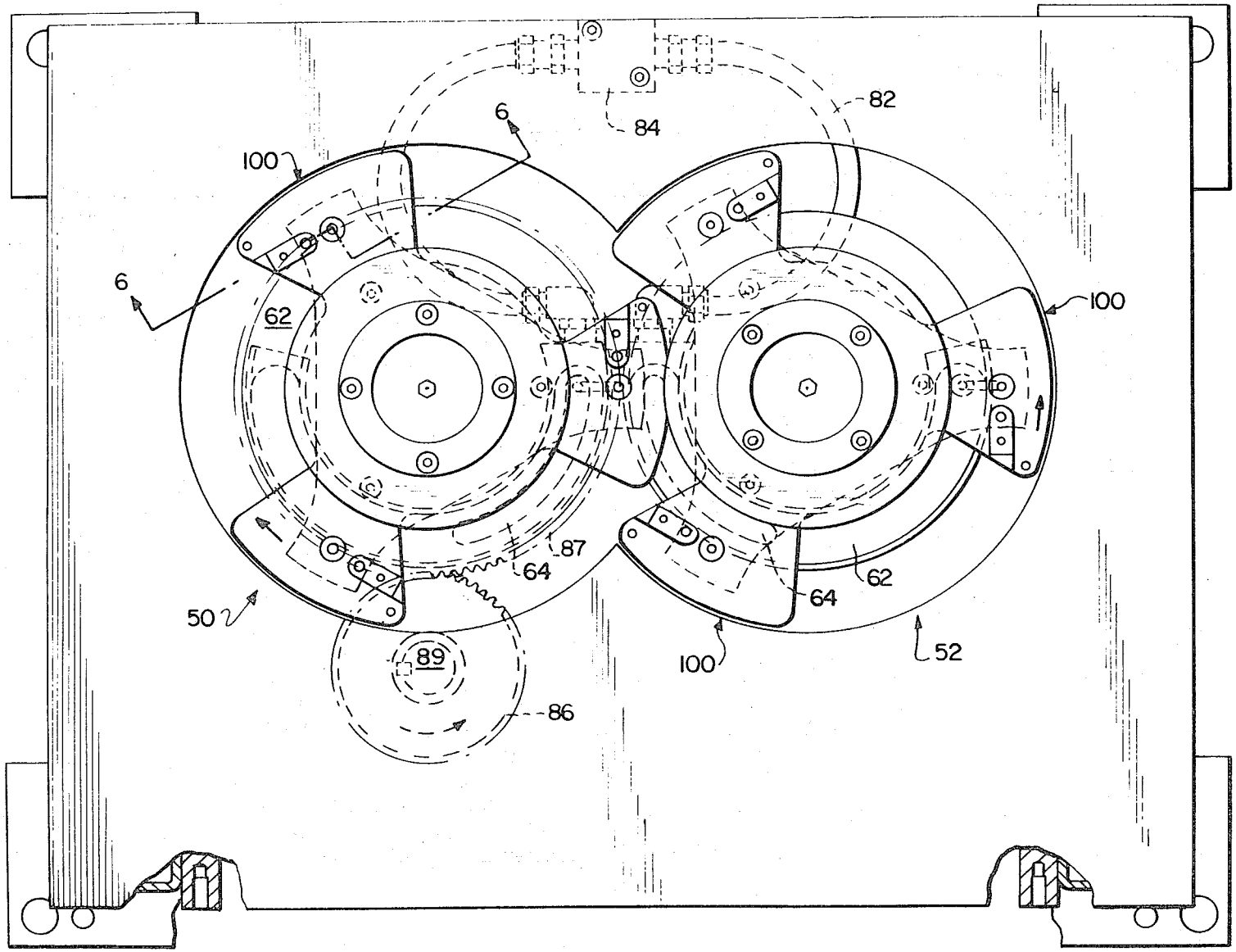
FIG. 2 is a view illustrating the star wheel mechanism.

Each of the feed screws 10 and 12 have an associated star wheel, 50 and 52 respectively, associated therewith. Star wheel 52 is attached by means of screws 54 to feed screw 12 for rotation therewith. However, star wheel 50 is not connected to feed screw 10, as screws 55 do not pass into star wheel 50. Rather, star wheel 50 is mounted around shaft 18 for rotation independent of feed screw 10 around bearings 56 and 58. Star wheel 50 includes geared wheel 87 which, as is best seen in FIG. 2, meshes with a geared wheel 86 having a shaft 89. As can be seen in FIG. 3, pulley 88 is mounted upon shaft 89. Another pulley 85 is mounted on shaft 89. This pulley 85 is driven through a timing belt or chain 91 by a pulley 93 mounted on a motor shaft 92 of drive motor 90. The gear 86 moves the gear 87 in the opposite direction to shafts 18 and 20. Star wheel 50 is attached to gear 87. A belt tightener 95 mounted on bracket 97 maintains tension in timing belt 36.

Thus, as can best be seen in FIG. 2, star wheels 50 and 52 rotate in opposite directions beneath feed screws 10 and 12, providing alternating can end capturing stations 100 for receipt of ends from the feed screws 10 and 12 at a work station beneath feed screws 10 and 12.

The shafts 18 and 20 are mounted within their base 38 by means of mounts 42 and 60, spring members 48, and screws 40, 44 and 46.

Figure 6:
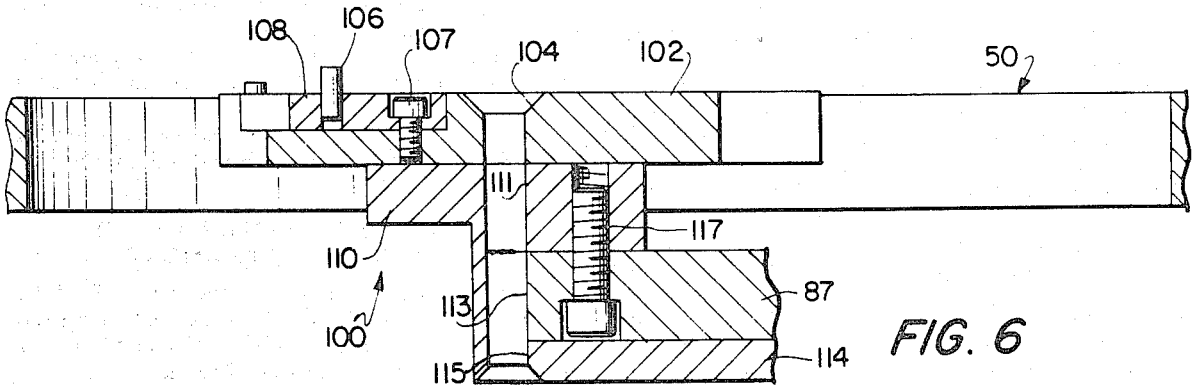
FIG. 6 is a cross-sectional view taken along line 6—6 of FIG. 3, illustrating the construction of the star wheels.

The construction of each of the stations 100 of star wheels 50 or 52 is best illustrated in FIG. 6. The star wheel stations 100 comprise a surface 102 upon which the can ends received from the screws 10 and 12 are carried. The surface 102 includes a passageway 104 which communicates with passageway 111 of element 110, passageway 113 of wheel 87 and passageway 115 of element in fluid flow relation with a vacuum plenum 64, as seen in FIG. 1 and best seen in FIG. 2. A guide post 106 is held within receptor 108. Screws 107 and 117 are used to complete the assembly.

Looking now at FIG. 2, as each star wheel station 100 passes beneath feed screws 10 and 12, a can end is fed to the station, in its inverted position. As can be seen in FIG. 1, the star wheel station 100, which is in position beneath feed screws 10 and 12, is in fluid communication with the vacuum plenum 64, which plenum is connected by means of line 82 to a source of vacuum 84. Thus, the end is firmly captured and held on to surface 102 of the station 100.

Figure 4:
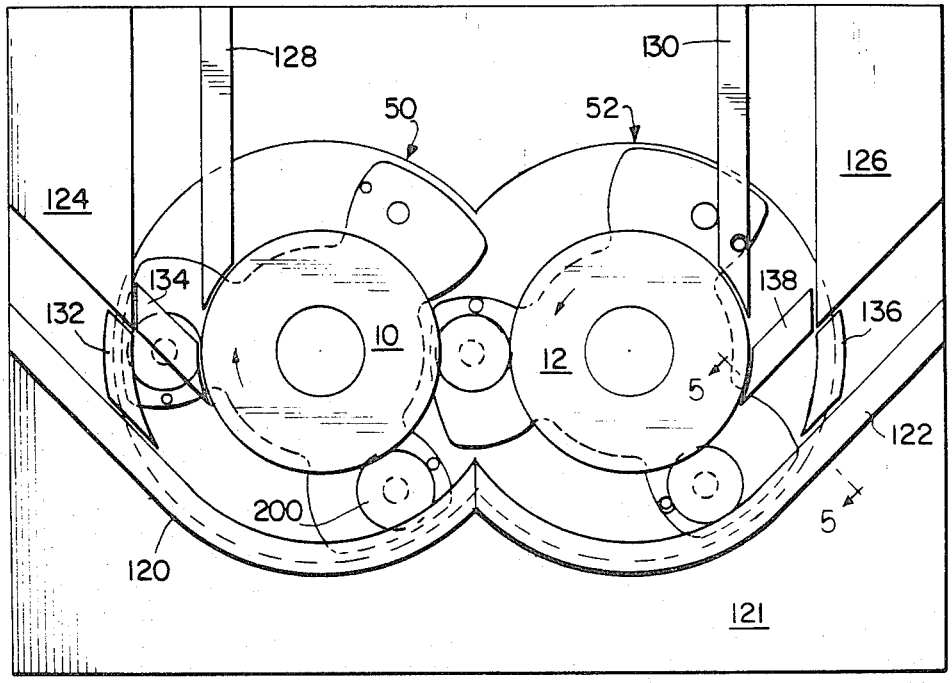
FIG. 4 is a top elevational view of the can end diverter, with the feed screws removed, illustrating the locations of the exit lanes.

FIG. 4 illustrates the actions which take place on the ends 200 as they pass from beneath feed screws 10 and 12. This FIGURE illustrates the guide rail system employed for transporting the ends 200. As the end 200 is carried from beneath the feed screws 10 and 12 by one of the star wheels 50 or 52, it is for a beginning portion of its journey held by vacuum plenum 64. Eventually, however, as can be seen in FIG. 2, plenum 64 ends. By that time, the end 200 is partially beneath guide rail 120 or 122 and is now pushed along its path by guide pin 106 of station 100.

Figure 5:
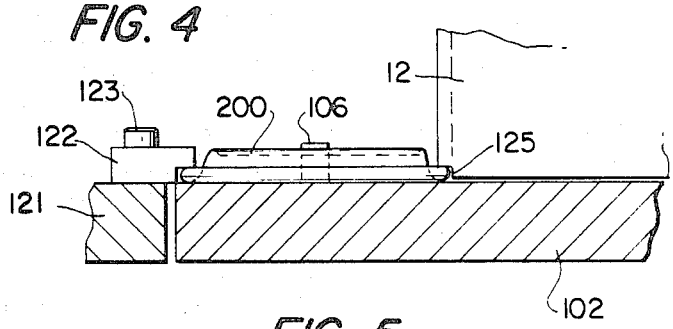
FIG. 5 is a cross-sectional view taken along line 5—5 of FIG. 4, illustrating the construction of the exit lanes.

FIG. 5 illustrates the positioning of an end 200 as it passes along guide rail 122. Guide rail 122 includes guide rail 122, which is sized to permit the outer flange region of end 200 to pass therebeneath, with screws 123 mounting guide rail 122 on to surface 121. Guide rail 120 is similarly constructed.

As the can ends 200 pass further along their path, they are no longer held on to surface 102 by plenum 64, which, as can best be seen in FIG. 2, ends somewhat in the area of 90° after it begins. The end 200 is now held only by guide rail 122, a groove 125 at the bottom of feed screw 12, and guide pin 106. Thus, the end 200 now seeks to move outwardly from the circle in which it is traveling, due to centrifical force. At this point, the end 200 reaches stops 132 and 134, if on star wheel 50, or stops 136 and 138, if on star wheel 52. In the normal operating mode, stops 132 and 136 would be in their downward position, and stops 134 and 138 would be in their upward position, guiding the ends 200 between guides 124 and 128 and 126 and 130 respectively. This is the feed to the next operating machine in the can end line. However, when, for any of a number of reasons, it is not desired to feed additional ends to one or both lanes of the next operating unit, stop 134 and/or 138 is lowered and stop 132 and/or 136 is raised, permitting the ends to pass along the tracks formed between guides 120 and 124 and/or guides 122 and 126.

The stops 132, 134, 136 and 138 are connected to air cylinders (not shown) for lowering and raising thereof. To avoid jamming, a timing pin 74 rotates with pulley 34. This pin 74 is connected by means of mounting 76 and screws 78 and 80 and passes within a metal detector 72. Thus, any signal given to the air cylinders controlling stops 132, 134, 136 and 138 are delayed until the star wheels 50 and 52 are in the correct position to permit changeover without the jamming of an end 200 beneath one of the stops 132, 134, 136 or 138, as determined by sensing of the position of pin 72.

Thus, it is clear that the present invention provides a means for taking can ends from a single stack, separating these cans into a pair of can end supplies and removing excess ends from the can end stream when required. This enables the elimination of an operator previously required for controlling end flow between portions of the can end forming system, reducing costs and increasing efficiency of the system.

While the invention has been described with reference to certain specific embodiments thereof, it is not intended to be so limited thereby, except as set forth in the accompanying claims.

I claim:

1. Apparatus for dividing an input stream of can ends into a pair of output streams comprising means for spacing and feeding said can ends to a work station, a pair of star wheel means for alternately receiving said can ends at said work station from said means for spacing and feeding, and guiding said can ends from said work station, output guides associated with each of said star wheel means for receiving said can ends from said star wheel means thereby providing a pair of output streams, and means operatively connected to said means for spacing and feeding said can ends and said star wheel means for driving said means for spacing and feeding and said star wheel means in timed relation.

2. The apparatus of claim 1 wherein said means for spacing and feeding said can ends comprises a pair of grooved feed screws.

3. The apparatus of claim 2 wherein said grooved feed screws are constructed and arranged to permit said can ends to pass therebetween by gravity without being driven therebetween and without substantial rotation of said can ends therebetween.

4. The apparatus of claim 1 wherein each of said pair of star wheel means comprises a plurality of stations, said stations including a can end receiving surface, a guide pin and a vacuum plenum.

5. The apparatus of claim 4 wherein said apparatus further comprises a vacuum plenum and vacuum supply means connected thereto in operative association with each of said star wheel means for a portion of their can end guiding.

6. The apparatus of claim 1 wherein said output guides each comprise a first and a second pair of guide rails and a stop associated with each pair of guide rails for selectively permitting said can ends to pass between one of said pairs of guide rails.

7. The apparatus of claim 6 wherein said stops are controlled by air cylinders.

8. The apparatus of claim 6 further comprising timing means associated with said means for driving for timing said stops such that said can ends are not jammed by said stops.

9. The apparatus of claim 1 wherein said means for driving comprises a motor and a timing belt operatively connected to said means for spacing and feeding said can ends and said star wheel means.

* * * * *